US010198881B2

(12) United States Patent
Huang

(10) Patent No.: US 10,198,881 B2
(45) Date of Patent: Feb. 5, 2019

(54) DIAGNOSTIC DEVICE FOR CHECKING THROTTLE VALVE OF VEHICLE

(71) Applicant: Chung-Yi Huang, Taichung (TW)

(72) Inventor: Chung-Yi Huang, Taichung (TW)

( * ) Notice: Subject to any disclaimer, the term of this patent is extended or adjusted under 35 U.S.C. 154(b) by 278 days.

(21) Appl. No.: 15/361,060

(22) Filed: Nov. 24, 2016

(65) Prior Publication Data

US 2017/0206719 A1 Jul. 20, 2017

(30) Foreign Application Priority Data

Jan. 14, 2016 (TW) ..... 105200491 U

(51) Int. Cl.
*F02D 9/00* (2006.01)
*G07C 5/08* (2006.01)
*F02D 11/10* (2006.01)

(52) U.S. Cl.
CPC ..... *G07C 5/0825* (2013.01); *F02D 11/107* (2013.01); *G07C 5/0858* (2013.01); *G07C 2205/02* (2013.01)

(58) Field of Classification Search
None
See application file for complete search history.

(56) References Cited

U.S. PATENT DOCUMENTS 6,225,898 B1 * 5/2001 Kamiya ..... G07C 5/008 340/10.1
6,941,203 B2 * 9/2005 Chen ..... G06Q 90/00 324/500
7,287,510 B2 * 10/2007 Costin ..... F02D 11/107 123/336
7,809,482 B2 * 10/2010 Bertosa ..... G07C 5/008 340/438
7,996,128 B2 * 8/2011 Bertosa ..... G07C 5/008 701/31.4
8,930,067 B1 * 1/2015 Green ..... G06Q 20/127 701/33.2
9,361,738 B2 * 6/2016 Gilbert ..... G06F 17/30047
9,476,372 B2 * 10/2016 Worthing ..... F02D 41/0002
9,500,148 B2 * 11/2016 Ide ..... F02D 35/0007
9,672,497 B1 * 6/2017 Lewis ..... G06F 17/277
10,026,241 B1 * 7/2018 Sankavaram ..... G07C 5/0808
D827,464 S * 9/2018 Hao ..... D10/78
2006/0123692 A1 * 6/2006 Beronja ..... G07C 5/0808 43/61

(Continued)

*Primary Examiner* — Jonathan M Dager
(74) *Attorney, Agent, or Firm* — Alan D. Kamrath; Kamrath IP Lawfirm, P.A.

(57) ABSTRACT

A diagnostic device includes a body with a circuit board located therein. The body includes a display screen and a function button unit located on the outside thereof. A connection port and an insertion hole are respectively located to the body. An information cassette is inserted in the insertion hole and electrically connected to the circuit board. A cable unit has a first end and a second end, wherein the first end of the cable unit is connected to the connection port, and the second end of the cable unit is connected to a power source and an output port of a cleaning device which is connected to the throttle valve. When the diagnostic device detects abnormal information of the throttle valve via the cable unit, the display screen displays the abnormal information, the cleaning device cleans the throttle valve. The diagnostic device diagnoses the throttle valve afterward.

4 Claims, 3 Drawing Sheets

(56) References Cited

U.S. PATENT DOCUMENTS

2007/0028220 A1* 2/2007 Miller ..... G05B 23/0278 717/124
2008/0214022 A1* 9/2008 Kowalick ..... H01R 13/443 439/34
2008/0223335 A1* 9/2008 Bauerle ..... F02D 11/107 123/349
2009/0276115 A1* 11/2009 Chen ..... G07C 5/008 701/29.6
2010/0057290 A1* 3/2010 Brillhart ..... G06Q 10/06 701/31.4
2010/0138701 A1* 6/2010 Costantino ..... G05B 23/0272 714/49
2010/0174446 A1* 7/2010 Andreasen ..... G07C 5/008 701/31.4
2010/0205450 A1* 8/2010 Sarnacke ..... B60R 25/00 713/185
2010/0293081 A1* 11/2010 Liu ..... G05B 19/048 705/34
2011/0246018 A1* 10/2011 Bertosa ..... G05B 19/0428 701/29.6
2011/0288954 A1* 11/2011 Bertosa ..... G06Q 30/0639 705/26.9
2013/0282229 A1* 10/2013 Wittliff, III ..... G07C 5/0808 701/33.2
2014/0150090 A1* 5/2014 Cicala ..... G06F 21/44 726/19
2014/0316621 A1* 10/2014 Martin ..... G01M 15/042 701/22
2014/0316622 A1* 10/2014 Martin ..... B60W 10/06 701/22
2015/0039176 A1* 2/2015 Fish ..... G07C 5/008 701/31.6
2015/0081163 A1* 3/2015 Molenkamp ..... G07C 5/00 701/33.2
2016/0102606 A1* 4/2016 Thompson ..... F02B 77/04 134/23
2016/0215690 A1* 7/2016 Thompson ..... F02B 77/04
2016/0252025 A1* 9/2016 Martin ..... F02D 21/02 701/102
2017/0159621 A1* 6/2017 Irwin ..... F02M 35/08
2018/0151003 A1* 5/2018 Grobler ..... G05B 23/0216
2018/0190041 A1* 7/2018 Hanson ..... G07C 5/008
2018/0247468 A1* 8/2018 Camacho ..... G07C 5/008

* cited by examiner

DIAGNOSTIC DEVICE FOR CHECKING THROTTLE VALVE OF VEHICLE

BACKGROUND OF THE INVENTION

1. Fields of the Invention

The present invention relates to a diagnostic device for vehicles, and more particularly, to a diagnostic device for checking throttle valves of a vehicle, and a cleaning device is connected to the throttle valves to clean the throttle valves.

2. Descriptions of Related Art

The operation of throttle valves of early vehicles comprises a cable connected between the throttle valve and the acceleration pedal, the cable is pulled to open the throttle valves when the acceleration pedal is pushed. For the modern vehicles, a sensor is used to detect the operational status of the throttle valves, and the detected information is sent to the engine control unit to precisely control the timing of the opening of the throttle valve to provide better fuel consumption features.

For protection the environment, an exhaust gas recycling system is developed to recycle the exhaust gas and the exhaust gas is guided back to the intake system to be burned again when the vehicle is idling. Carbon is accumulated and attached on the valve and affects the performance of fuel consumption. Another system called positive crank ventilation is able to guide the mixture of gasoline and air in the crank box into the engine to be burned again, and this may also cause the accumulation of carbon. Therefore, the timing for cleaning the accumulated carbon particles on the valves is important to keep the engine in a satisfied status. The conventional cleaning device is connected to the valve to be cleaned and after the cleaning processes of the cleaning device are completed, the cleaning device is removed and the engine needs to be put on idling status for ten minutes. However, there is no way to check the engine is in its default status after cleaning.

The present invention intends to provide a diagnostic device for checking throttle valves of a vehicle so that the maintainers can use a cleaning device to clean the throttle valves. By checking the intake air and the exhaust, the diagnostic device detects whether or not the engine is in its default status after cleaning.

SUMMARY OF THE INVENTION

The present invention relates to a diagnostic device and comprises a body with a circuit board located therein. The body includes a display screen and a function button unit located on the outside thereof. A connection port and an insertion hole are respectively located to the body. An information cassette is inserted in the insertion hole and electrically connected to the circuit board. A cable unit has a first end and a second end, wherein the first end of the cable unit is connected to the connection port, and the second end of the cable unit is connected to a power source and an output port of a cleaning device which is connected to the throttle valve. When the diagnostic device detects abnormal information of the throttle valve via the cable unit, the display screen displays the abnormal information, the cleaning device cleans the throttle valve. The throttle valve is diagnosed after the cleaning process is completed to diagnose whether or not the throttle valve is set to the default value.

The primary object of the present invention is to provide a diagnostic device which is able to diagnose whether or not the throttle valve is set to its default values after being cleaned.

Another object of the present invention is to provide a diagnostic device which does not have to be connected to the engine control unit of the vehicle to diagnose the throttle valve.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
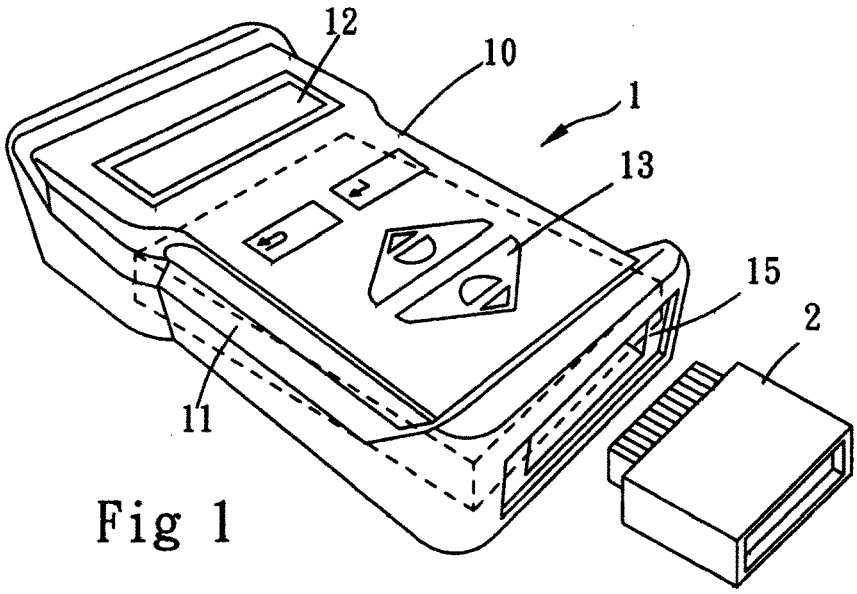
FIG. 1 shows the diagnostic device of the present invention.
Figure 2:
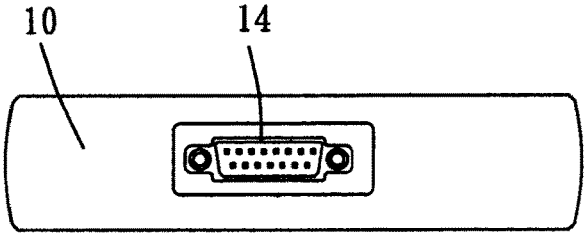
FIG. 2 shows one end of the diagnostic device of the present invention.
Figure 3:
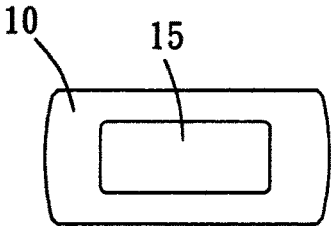
FIG. 3 shows the other end of the diagnostic device of the present invention.

Referring to FIGS. 1 to 4, the diagnostic device 1 of the present invention comprises a body 10 which is composed of two parts which are connected to each other to define a space in the body 10. A circuit board 11 is located in the space in the body 10. A display screen 12, preferably a Liquid Crystal Display, is located on the outside of the body 10 so as to display information of the throttle valve to be checked. A function button unit 13 is located on the outside of the body 10 so that the users can choose the functions shown in the display screen 12. A connection port 14 (15PIN) is located at the top end of the body 10, and an insertion hole 15 is formed at the bottom end of the body 10.

An information cassette 2 is inserted in the insertion hole 15 and electrically connected to the circuit board 11, wherein the information cassette 2 has necessary information of the throttles of the vehicle, such as the brand, the number of the throttle valves of the engine, the reference values of the throttle valves written therein.

Figure 4:
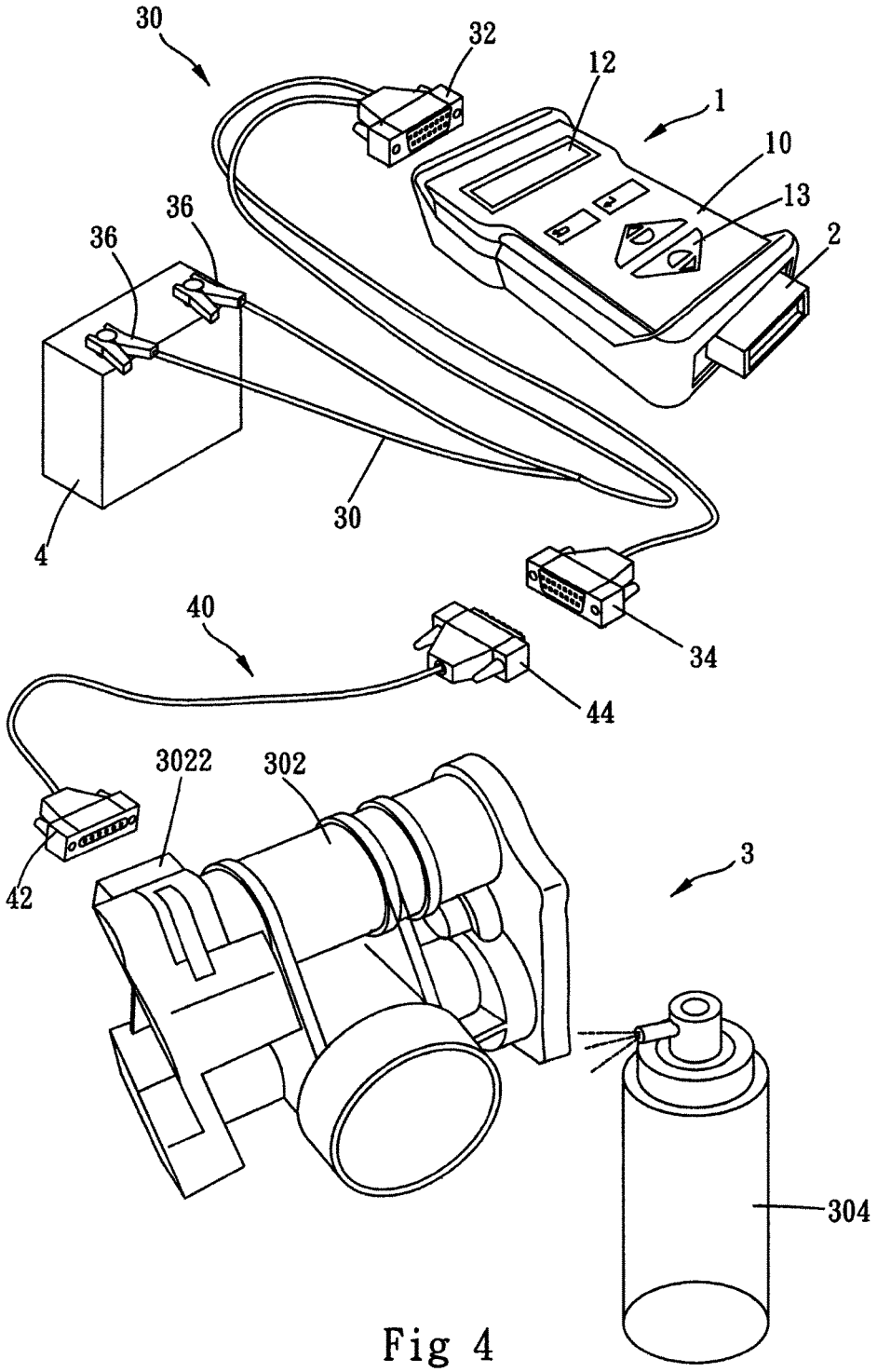
FIG. 4 shows the power source, the cable unit, the cleaning device and the diagnostic device of the present invention.

A cable unit can be a single cable unit or dual-cable unit as shown in FIG. 4. The cable unit comprises a first cable unit 30 and a second cable unit 40. The first cable unit 30 includes a first connection end 32 which is connected to the connection port 14 of the body 10, and a second connection end 34 and a clip end 36 extend from the first connection end 32. The clip end 36 is connected to the power source 4, wherein the clip end 36 includes two clips and the power source 4 is the battery of a vehicle. The two clips are respectively connected to the positive pole and the negative pole of the battery. In other words, the use of the diagnostic device 1 of the present invention does not need to be connected to an exterior power source, the power source 4 is the vehicle's battery.

The second cable unit 40 includes a third connection end 42 and a fourth connection end 44, wherein the third connection end 42 is connected to the output port 3022 (5PIN) of the seat 302 of the cleaning device 3, and the fourth connection end 44 is connected to the second connection end 34 of the first cable unit 30. The first, second and fourth connection ends 32, 34, 44 each are a 15PIN connection end, so that the second cable unit 40 is connected between the diagnostic device 1 and the cleaning device 3. Of course, when the fist connection end 15 is a 15PIN connection end and the second connection end 34 is a 5PIN connection end, the cable unit is the single cable unit. By the cable unit, the information of the response of the operation of the cleaning device 3 can be displayed on the display screen 12.

The cleaning device 3 includes a seat 302 and a cleaning bottle 304, wherein the seat 302 is able to be connected to the throttle valve. The seat 302 has the output port 3022 which is a 5PIN port which is connected to the third connection end 42 of the second cable unit 40. By the first and second cable units 30, 40, the cleaning device 3 receives information from the diagnostic device 1 to clean the throttle valve by using the detergent or agent in the cleaning bottle 304.

Figure 5:
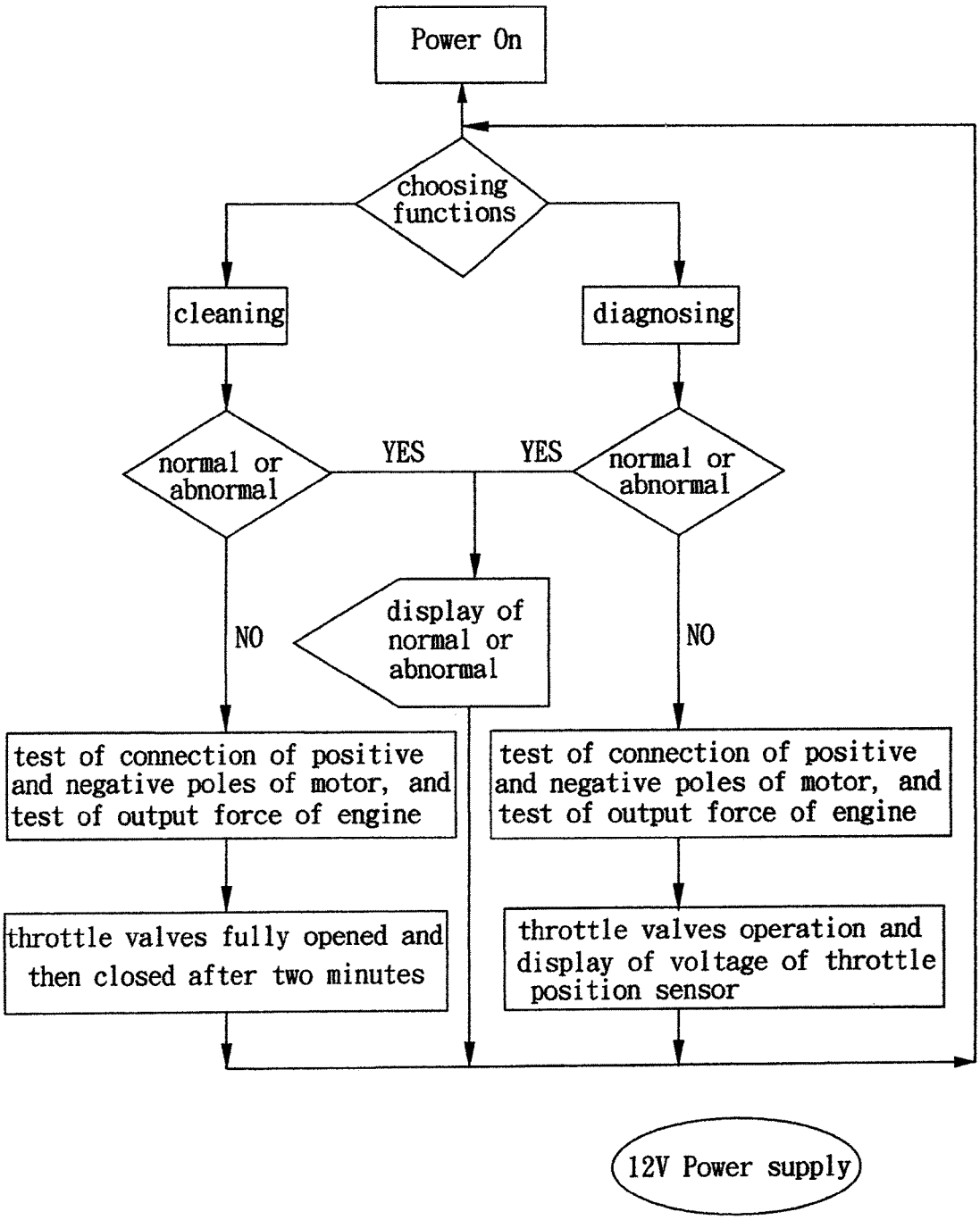
FIG. 5 shows the flow chart of the operation of the diagnostic device of the present invention.

As shown in FIGS. 4 and 5, when in use, the information cassette 2 with the proper information of the vehicle is inserted into the insertion hole 15 of the body 10. The first connection end 32 is connected to the connection port 14 of the body 10, and the clip end 36 is connected to the power source 4 to provide power to the diagnostic device 1.

The second connection end 34 is connected to the fourth connection end 44, and the third connection end 42 is connected to the output port 3022 (5PIN) of the seat 302 of the cleaning device 3. The users operate the function button unit 13 to choose the function of diagnosis from the display screen 12. Compare the default values of the engine obtained from the information cassette 2 and the response information transmitted from the throttle valve via the cable unit. The result of comparison is displayed on the display screen 12 so that the users are acknowledged if there is any abnormal information. If the status of the throttle valve is normal, that is to say, the depth of the acceleration pedal pushed is correspondent to the amount of intake air of the throttle valve, this means "normal". Then the fuel pump of the engine is tested by pushing the acceleration pedal hard to mix the fuel and the air to test the connection of the positive and negative poles of the motor, and the output force of the engine. The throttle valve is then closed for few minutes to check the exhaust, if the exhaust meets the air care standard, the throttle valve is normal without accumulation of carbon.

On the contrary, if the depth of the acceleration pedal pushed is not correspondent to the amount of mixture of the intake air and the fuel into the throttle valve, this means "abnormal", the abnormal information is displayed by flashing on the display screen 12. Preferably, a red light is located on the body 10 to provide the warning signal of the abnormal situation. A green light may be used to indicate the normal situation. The users then pours the detergent or agent of the cleaning bottle 304 into the throttle valve to clean the accumulated carbon. After the cleaning step is completed, the response information from the throttle valve is read from the diagnostic device 1 via the first and second cable units 30, 40 again. If another "abnormal" is displayed, the cleaning step is proceeded again, until the "normal" is obtained.

Then, the acceleration pedal is pushed to its maximum depth to open the throttle valve to its maximum degree for two minutes to remove all the cleaning detergent or agent from the throttle valve. When the above steps are completed, the users choose the function of diagnosis again to check if the depth of the acceleration pedal pushed is correspondent to the amount of intake air of the throttle valve, and then to check the amount of the mixture of the fuel and the intake air. If the result meets the requirements of the air care standard, this means all of the accumulated carbon is cleaned from the throttle valve.

The advantages of the present invention are that the diagnostic device 1 does not have to be connected with the engine control unit of the vehicle, simply inserting the information cassette 2 into the insertion hole 15 of the body 10 of the diagnostic device 1 to quickly know situation of the accumulation of carbon on the throttle valve.

The diagnostic device 1 can directly check the intake air and the fuel pump to ensure the intake air and the exhaust to meet related regulations.

The power for the diagnostic device 1 is provided by the vehicle's battery, so that the diagnosis can be done even if there is no exterior power source is available. The body 10 of the diagnostic device 1 is compact and light because no power supply is built in the body 10.

While we have shown and described the embodiment in accordance with the present invention, it should be clear to those skilled in the art that further embodiments may be made without departing from the scope of the present invention.

What is claimed is:

1. A diagnostic device comprising:

a body comprising two parts which are connected to each other to define a space in the body, a circuit board located in the space in the body, a display screen located on an outside of the body so as to display information of a throttle valve to be checked, a function button unit located on the outside of the body, a connection port and an insertion hole respectively located to the body, and an information cassette inserted in the insertion hole and electrically connected to the circuit board, a cable unit having a first end and a second end, the first end of the cable unit connected to the connection port, the second end of the cable unit connected to a power source and an output port of a cleaning device which is connected to the throttle valve, when the diagnostic device detects abnormal information of the throttle valve via the cable unit, the display screen displays the abnormal information.

2. The diagnostic device as claimed in claim 1, wherein the cable unit includes a first cable unit which includes a first connection end which is connected to the connection port of the body, a second connection end and a clip end extend from the first connection end, the clip end is connected to the power source, the second connection end is connected to the output port of the cleaning device.

3. The diagnostic device as claimed in claim 1, wherein the cable unit includes a first cable unit and a second cable unit, the first cable unit includes a first connection end which is connected to the connection port of the body, a second connection end and a clip end extend from the first connection end, the clip end is connected to the power source, the second cable unit includes a third connection end and a fourth connection end, the third connection end is connected to the output port of the cleaning device, the fourth connection end is connected to the second connection end of the first cable unit.

4. The diagnostic device as claimed in claim 1, wherein the power source is a battery of a vehicle.

* * * * *